US005416999A

United States Patent [19]

Coury

[11] Patent Number: 5,416,999

[45] Date of Patent: May 23, 1995

[54] DELTA WEAPON SYSTEM (DWS)

[76] Inventor: William S. Coury, 2830 Bay Shore Cir., Sarasota, Fla. 34234

[21] Appl. No.: 126,915

[22] Filed: Sep. 24, 1993

[51] Int. Cl.[6] ..... F41C 3/14

[52] U.S. Cl. ..... 42/59; 42/39.5

[58] Field of Search ..... 42/59, 39.5; 89/156

[56] References Cited

U.S. PATENT DOCUMENTS

| | | | |
|---|---|---|---|
| 75,016 | 3/1968 | Holman | 42/59 |
| 3,765,116 | 10/1973 | Zaid | 42/59 |
| 3,797,153 | 3/1974 | Hagan | 42/39.5 |
| 4,156,981 | 6/1979 | Lusk | 42/59 |
| 4,455,777 | 6/1984 | Callies | 42/59 |

*Primary Examiner*—David Brown

*Attorney, Agent, or Firm*—Needle & Rosenberg

[57] ABSTRACT

This invention relates to a lightweight, shoulder-fired, flat-trajectory, disposable, multi-shot weapon system. In particular, this invention relates to a disposable weapon system which is designed to shoot ammunition rounds capable of penetrating one inch or more of rolled homogenous armor. Specifically, the present invention provides a deposable weapon system in which the materials are chosen to minimize weight, to cut the production cost, and to maximize safety.

11 Claims, 6 Drawing Sheets

DELTA WEAPON SYSTEM (DWS)

BACKGROUND OF THE INVENTION

1. Field of the Invention

This invention relates to a lightweight, shoulder-fired, flat-trajectory, disposable, multi-shot weapon system. In particular, this invention relates to a disposable weapon system for shooting ammunition rounds capable of penetrating armor personnel carriers (APC), wherein the weapon system is designed to minimize weight, to minimize cost, and to maximize safety.

2. Background Art

Military operations have demonstrated the need for a weapon, to be used by infantry troops, capable of incapacitating armored vehicles. This task, however, has proven to be difficult. The weapons currently available to infantry forces lack the capability to damage such vehicles.

To illustrate the difficulty in destroying armored vehicles, an example is helpful. Some APCs are constructed of approximately two inches of rolled homogenous armor (RHA) and are capable of traveling at speeds of approximately 35 miles per hour. These two factors, coupled with the distance that a solider is positioned away from the vehicle when firing his weapon, make the APC almost immune from small platoon attacks.

Some weapons do exist that are capable of penetrating the two inches of metal shielding an APC. However, many of these weapons lack a flat-trajectory projectile path, thus making the likelihood of hitting the target extremely small. In other words, a remote probability exists that a weapon will hit a target moving up to 35 miles per hour at a distance of over 200 meters using a "lob" trajectory path.

Additionally, the existing weapon systems with the same capabilities as the present invention are fired "over the shoulder" or from a platform. One reason for this type of firing method is that the weapons are bulky and heavy, which also negates the feasibility of use by infantry forces. Also, these weapons are fired from a position other than against a solider's shoulder because the resulting back-blast could injure the weapon user. Furthermore, this back-blast makes firing these weapons impracticable in closed spaces and extremely dangerous to fire forward of other soldiers or supplies.

The existing weapons are also expensive. The weapons are designed to withstand a large number of firings, possibly 10,000 rounds or more. The materials, therefore, must be manufactured to endure the peak stresses and the average stresses of every firing plus withstand the cyclic loading for each firing. As a result, the engineering design not only increases the cost of these weapons, but also creates an unwieldy weapon for infantry troops.

SUMMARY OF THE INVENTION

The present invention in the presently preferred embodiment comprises an ammunition round capable of penetrating at least approximately one inch of rolled homogenous armor (RHA), a means for firing the ammunition round, a cylinder that slidably receives the ammunition round and withstands the firing forces of the ammunition round, a magazine holding the cylinders and the associated ammunition rounds, a barrel that aligns with the ammunition rounds in the magazine through which the projectile travels, and a means to rotate the magazine.

Unlike other armor penetrating weapons, the present invention is fired the same as a conventional rifle. The characteristics that make the weapon system of the present invention similar to a rifle are its shoulder-fired and flat-trajectory aspects. In contrast, the present invention is different from a rifle because it is disposable and designed to minimize weight.

The first object of the weapon system of the present invention is to be shoulder-fired instead of fired "over the shoulder" or from a platform. This difference with the prior art affords the present invention with many advantages. First, the accuracy of the weapon increases. This accuracy improves because the flat-trajectory projectile path and the ease of aiming a shoulder-fired weapon. Next, the safety increases for the weapon user and for others in his vicinity because the weapon system of the present invention contains the firing exhaust instead of having a back-blast.

In addition to being shoulder-fired, another objective of the present invention is the capability to pierce armor vehicles. The present invention provides a weapon system that is capable of penetrating approximately one inch or more of RHA. Although the weapon system of the present invention operates similarly to conventional shoulder-fired weapons such as a rifle, the present invention has greater firepower than its rifle counterpart. This increased firepower is possible because the weapon system is non-reusable. After shooting the number of pre-loaded ammunition rounds which the weapon is designed to withstand, then the user disposes of the weapon. By designing a disposable weapon, the stresses that the weapon system must endure are lower, thus allowing the present weapon to fire sufficiently large armor piercing projectiles necessary to penetrate the aforementioned armor.

Other objectives of the present invention involve the cost, weight and safety of the weapon system of the present invention. It is contemplated by the present invention that the materials be chosen based upon certain factors. One important consideration is the strength of the material. Another factor is the weight of the material. Also, the cost of the material is an important consideration. Examples of preferable materials include, but are not limited to, titanium alloys, stainless steel, carbon graphics, polymers, ceramics, and the like. In addition to minimizing cost of materials, the expense of the weapon may be further reduced because it may use the design of parts from other weapons that are common in the art, such as a recoil sensitive rifle butt and a recoil sensitive rifle stock.

The present invention satisfies the need in the art for an armor piercing weapon that infantry troops may fire from all locations, including enclosed areas. In addition to the ability to use the present invention regardless of location with a high degree of accuracy, it may be manufactured from lightweight components that are chosen to be cost effective. The preferred embodiment of the disposable weapon costs approximately $1,000 to $2,000, a modest price in comparison to the approximately $1,000,000 price tag of an APC.

BRIEF DESCRIPTION OF THE DRAWINGS

FIG. 1B is the partial cross-section view of one half of the embodiment of FIG. 1A showing the internal components of the weapon system.

FIG. 2A is a side longitudinal view and FIG. 2B is a cut-away of the view of FIG. 2A.

FIG. 3A shows the cylinder without the concave end cap attached, and FIG. 3B shows the concave end cap welded to the cylinder.

DESCRIPTION OF THE PREFERRED EMBODIMENT

Figure 1A:
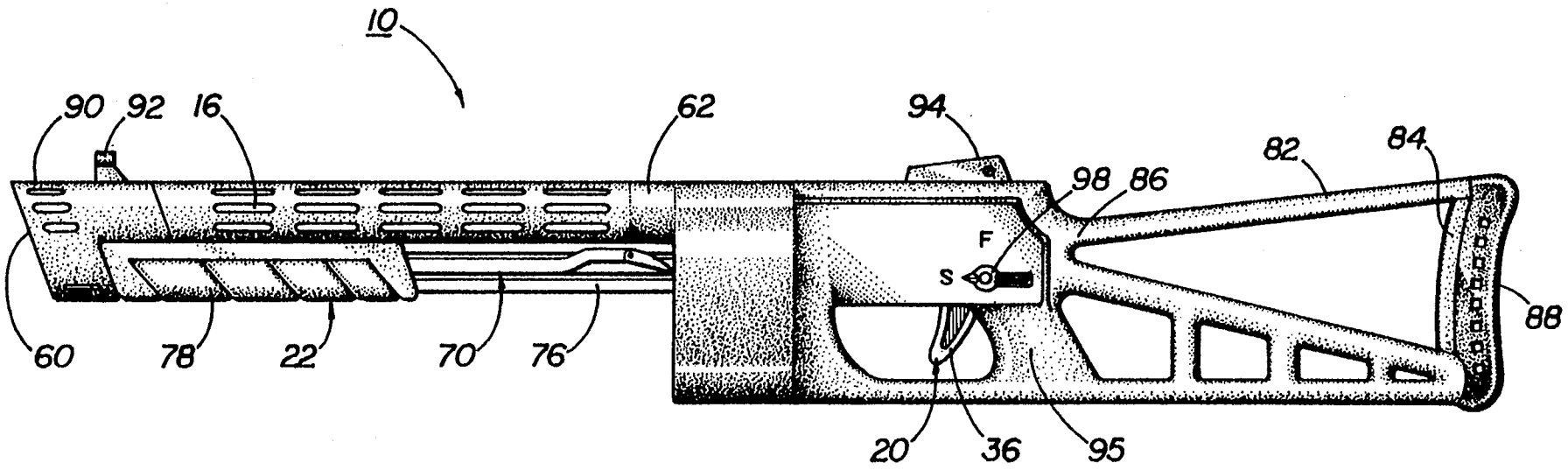
FIG. 1A is a side view of one embodiment showing the weapon system.

The present invention may be understood more readily by reference to the following detailed description of specific embodiment with reference to the Figures in which like numbers refer to like parts throughout the views.

Referring generally to FIGS. 1–7, the present invention provides a disposable, lightweight, shoulder-fired, flat-trajectory, multi-shot weapon system 10 comprising an ammunition round 12, a means 20 to fire the ammunition round 12, a non-reusable magazine 14, cylinders 18 within the magazine, a barrel 16, and a means 22 to rotate the magazine 14.

Figure 2A:
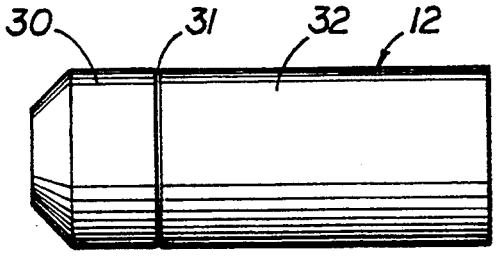
FIGS. 2A and 2B are views of an ammunition round.
Figure 2B:
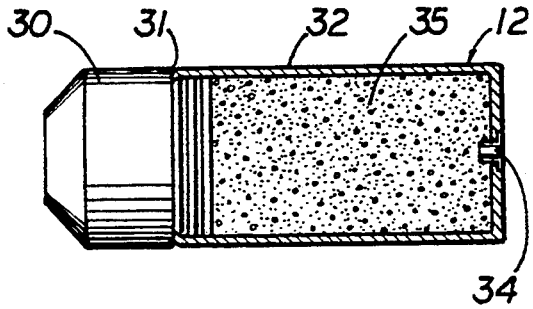

The ammunition round 12, as shown in FIG. 2A and FIG. 2B, comprises a projectile 30 capable of penetrating approximately one inch or more of rolled homogenous armor (RHA), and a casing 32 for containing a propellant charge 35. The juncture of the casing 32 and the projectile 30 may be sealed with a crimp 31. The presently preferred embodiment uses a projectile 30 which is a 35 mm explosively formed penetrator. Upon hitting the armored target, the projectile 30 explodes (i.e., high explosive or Monroe effect) and burns through the metal with enough energy to cause behind armor lethality. The projectile 30 may also contain a reduced-size, conventional fuse. Additionally, at 35 mm in diameter, the projectile 30 is small enough to hit a moving armor target at a distance of approximately 250 meters and the target moving at a rate of approximately 35 miles per hour. To hit the above described target, the propellant charge 35 must be sufficient to launch the projectile 30 at high velocity. The propellant charge 35 of the ammunition round 12 in the presently preferred embodiment causes the projectile 30 to exit the front end 60 of the barrel 16 at a velocity of approximately 860 feet per second or more. The casing 32 may be the standard type in the art.

Figure 7:
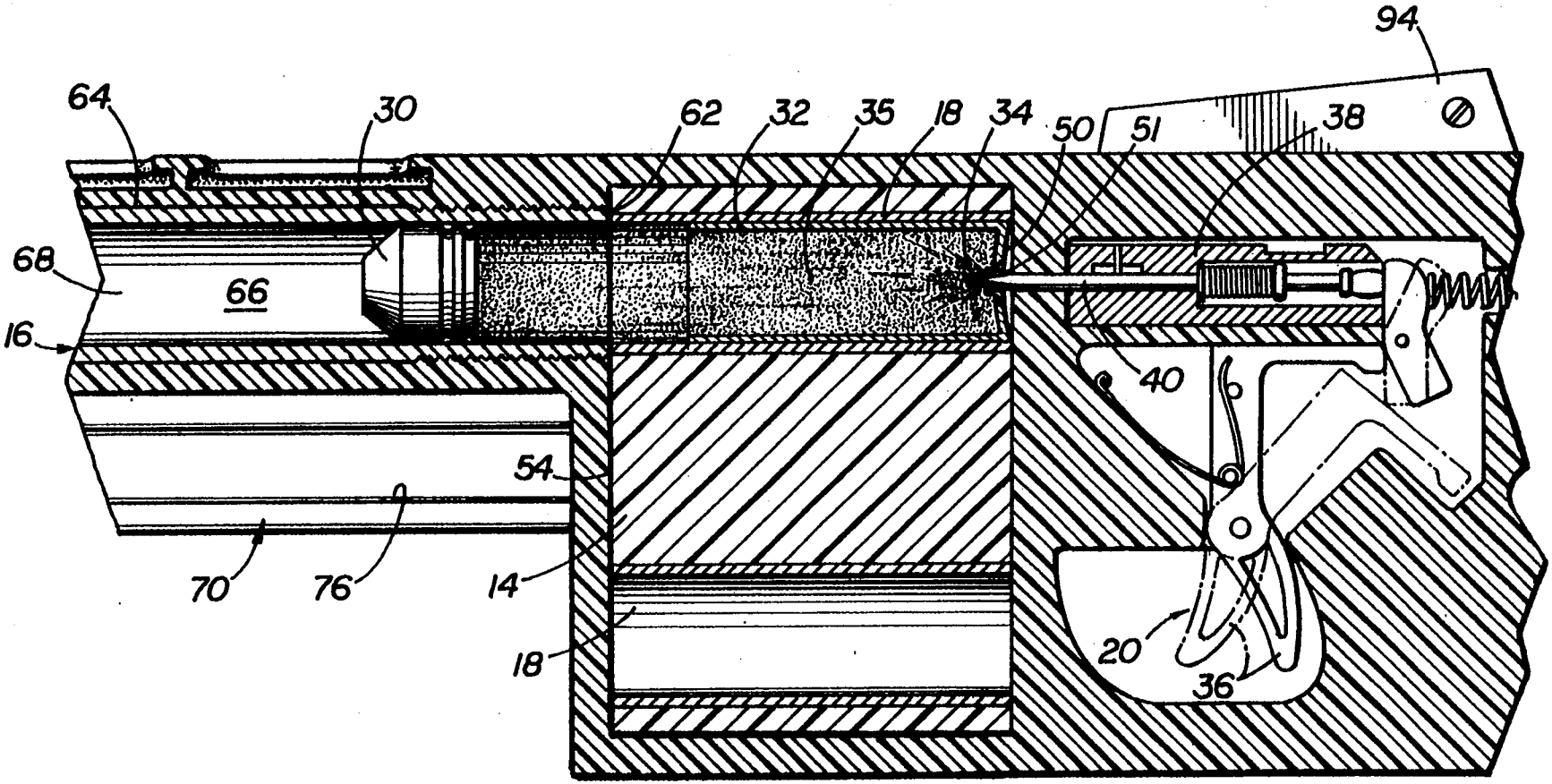
FIG. 7 is a side view of the weapon system that shows the firing pin striking the ammunition round.

The means 20 for igniting the propellant charge 35 of the ammunition round 12 causes the ammunition round 12 to fire. As shown in FIG. 1B and FIG. 7, the igniting means 20 may comprise a trigger mechanism 36 causing the propellant charge 35 to rapidly inflame, forcing the projectile 30 from the ammunition round 12 and then into and through the barrel 16. The trigger mechanism 36 may be a bolt 38 and firing pin mechanism 40. The firing pin 40 transverses the hole 51 in the concave end cap 50 of the cylinder 18 and strikes the casing 32 of the ammunition round 12. As FIG. 7 illustrates, the firing pin 40 then may impact an ignition device 34 within the ammunition round 12. The presently preferred embodiment of the ignition device 34 shown in FIG. 2B and FIG. 7 is a primer which is common in the art. The mechanical agitation of the ignition device 34 causes the propellant charge 35 to ignite. The propellant charge 35 then would start a rapid exothermic reaction that rapidly increases the pressure within the ammunition round 12, forcing the projectile 30 from the casing 32 and through the barrel 16. In an alternative embodiment not shown, the trigger mechanism 36 may be an electronic triggering device which is known in the prior art.

Figure 3A:
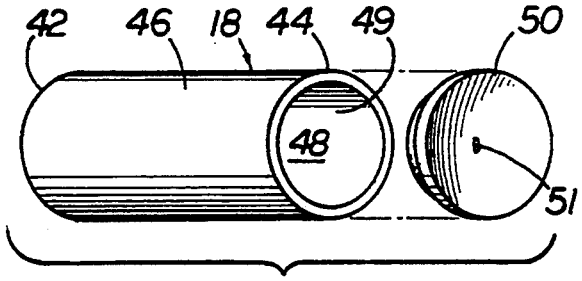
FIGS. 3A and 3B are perspective views of the cylinder of the invention.
Figure 3:
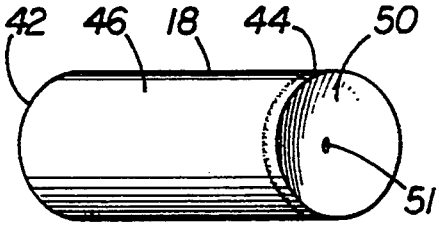

Referring now to FIGS. 3A and 3B, the cylinder 18 has a first end 42, a second end 14, an external surface 46, and an inner surface 48. The inner surface 48 forms an inner volume 49 complementary in size to and capable of slidably receiving the ammunition round 12 therein. A concave end cap 50, which is designed to best handle the explosive pressures and stresses, may attach to the second end 44 of the cylinder 18 so as to form a pressure tight seal strong enough to withstand the firing forces of the ammunition round 12. The concave end cap 50 may be constructed with a hole 51 in its center to facilitate the operation of the firing pin mechanism 40 of the igniting means 211. In the presently preferred embodiment, the cylinder 18 and the attached concave end cap 50 are high strength alloys capable of withstanding approximately 6,400 psi average pressure and approximately 15,000 psi peak pressure. For example, the material may be a high strength alloy such as a titanium alloy. Using a titanium alloy, the cylinder 18 and the attached concave end cap 50 satisfy the pressure requirements with a minimum factor of safety of approximately 2.0.

In an alternative embodiment, the casing 32 of the ammunition round 12 may be designed and constructed with enough strength to withstand the firing forces of the ammunition round 12, which may reach 15,000 psi peak pressure and 6,400 psi average pressure. To withstand this stress loading, a material such as a titanium alloy may be used to construct the casing 32. In this embodiment, the cylinder 18 is not necessary; instead, the ammunition round 12 directly contacts the magazine 14.

Figure 4B:
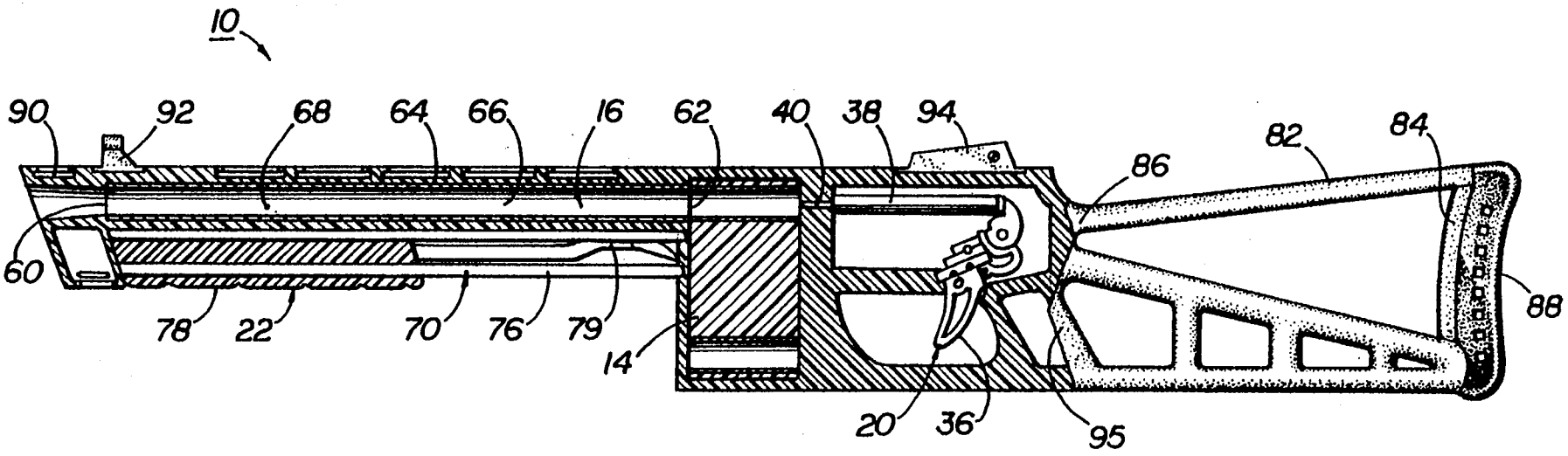
FIG. 4B is a perspective view of the magazine of FIG. 4A showing one ammunition round loaded.
Figure 4A:
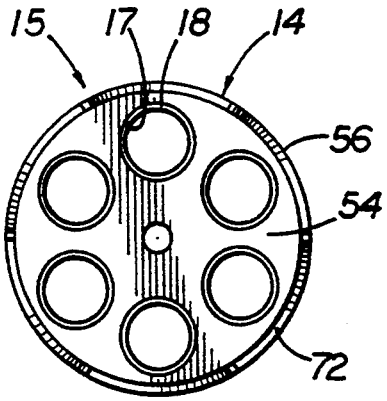
FIG. 4A is a end view of the magazine for the weapon system.
Figure 4B:
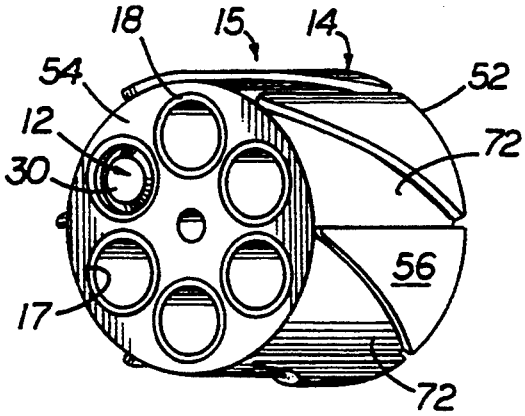

Referring now to FIGS. 4A and 4B, the magazine 14 has a plurality of through-bores 17 complementary to and surrounding a plurality of the cylinders 18 and the associated concave end caps 50 designed for holding the ammunition rounds 12. This allows multiple firings of ammunition rounds 12 from the weapon system 10. The number of ammunition rounds 12 in a magazine 14 may range from two to ten or more. In the presently preferred embodiment, the magazine 14 may comprise a drum-shape container 15 having an aft flat exterior side 52, a forward flat exterior side 54, and a middle curved exterior side 56. The projectile 30 remains unobstructed by the forward flat exterior side 54, thus providing a clear path to the central bore 68 of the barrel 16. The magazine 14 may consist of lightweight, inexpensive, moldable material. For example, the magazine 14 may consist of carbon graphics, or, for another example, ceramic material.

In an alternative embodiment, the magazine 14 may be constructed of materials sufficient in strength to withstand the firing force of the ammunition round 12.

For example, the material may be a strong ceramic or polymer material or a product yet to be developed. In this alternative embodiment, the cylinder 18 and the attached concave end cap 50 would no longer need to be designed to withstand the firing pressures since the material comprising the magazine 14 would now withstand these firing stresses.

Figure 5:
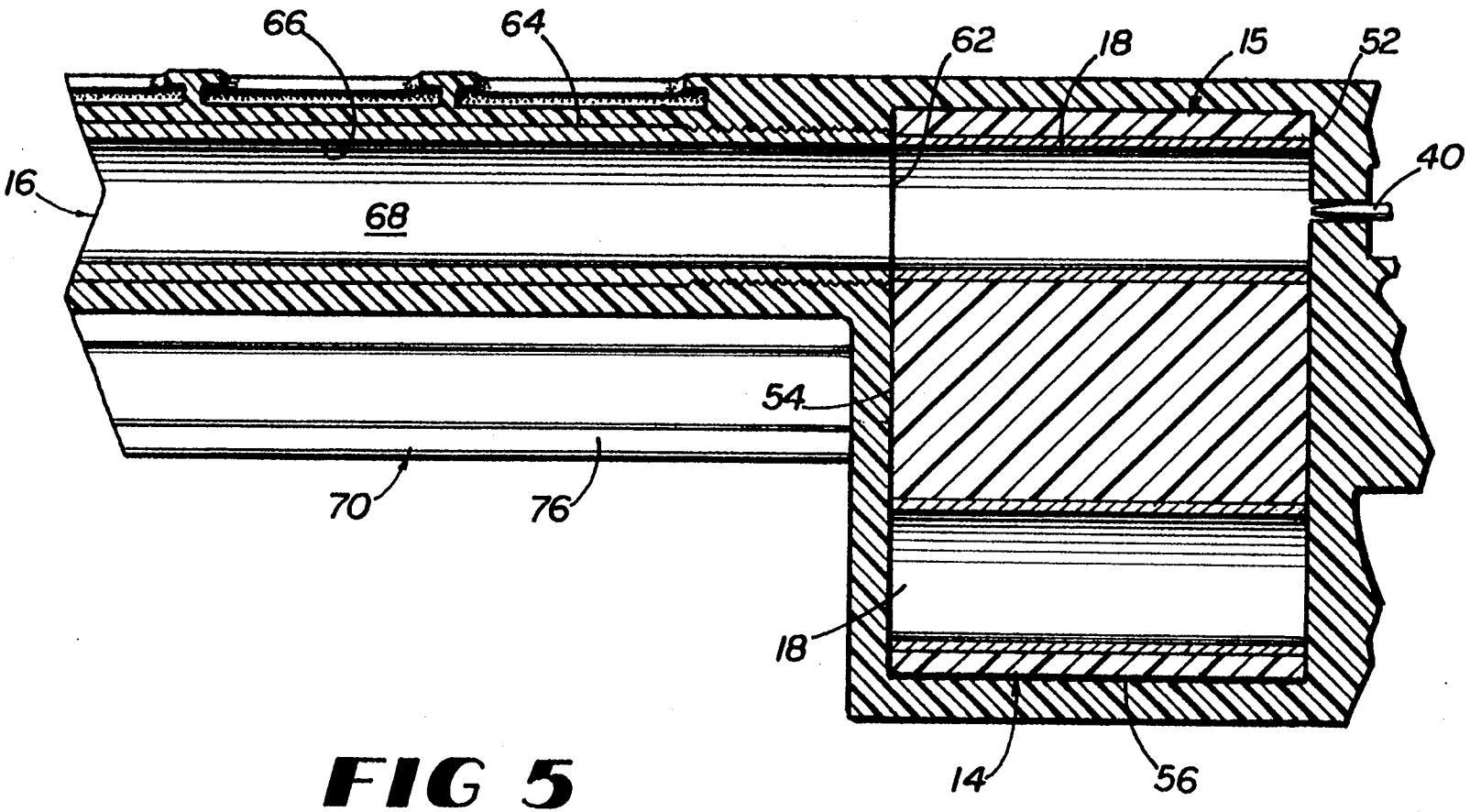
FIG. 5 is a side view of the weapon system showing the magazine aligning with the barrel.

As shown in FIG 1B, the barrel 16 is located forward of the magazine 14. The barrel 16 has a front end 60, a rear end 62 adjacent to the magazine 14, an outside surface 64, and an inside surface 66. The inside surface 66 forms a central bore 68 which aligns with one of the cylinders 18 within the magazine 14. As shown in FIG. 5, the juncture of the barrel 16 and the magazine 14 forms a pressure tight seal. The pressure tight seal results because forward flat exterior side 54 of the magazine 14 is machined to adjoins the rear end 62 of the barrel 16 and form a pressure tight seal. This seal allows each projectile 30 of the ammunition round 12 to transverse the central bore 68 and exit the front end 60 of the barrel 16 with its maximum velocity for the propellant charge used. In the presently preferred embodiment, the barrel 16 is engineered with a safety factor specifically to withstand the stress loading of firing the ammunition rounds 12 contained within the magazine 14 only and no more firings. The minimum factor of safety is approximately 2.0. The number of ammunition rounds 12 in a magazine 14 may range from two to ten or more.

Figure 6A:
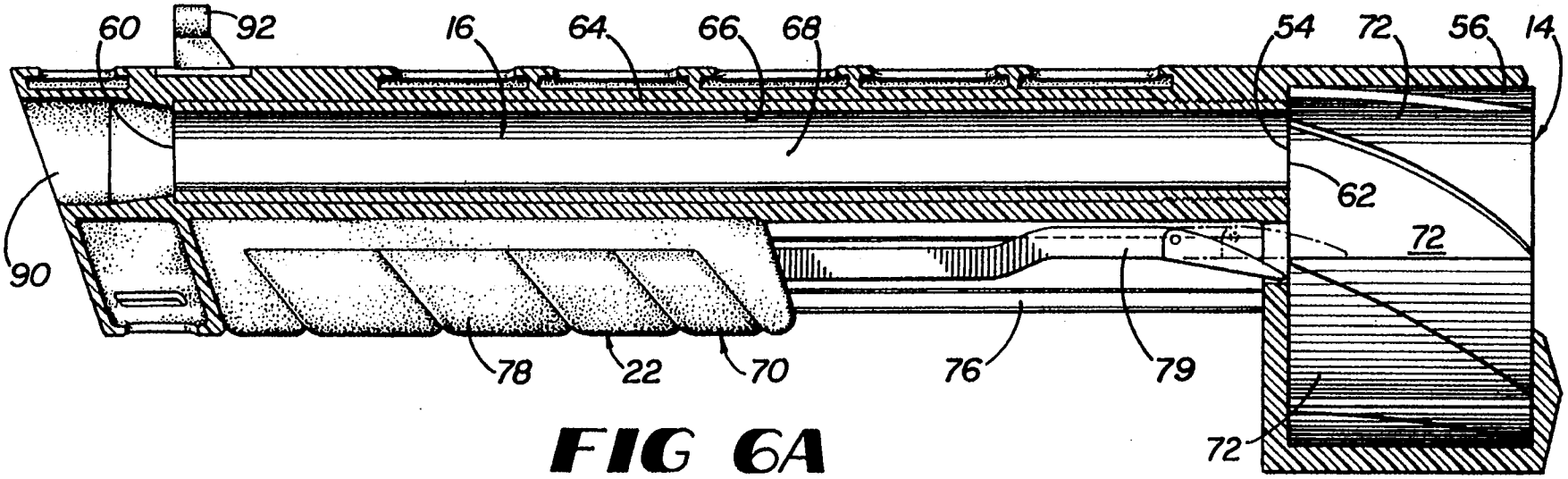
FIGS. 6A and FIG. 6B are side views of one embodiment that shows the magazine being advanced to the next round.
Figure 6B:
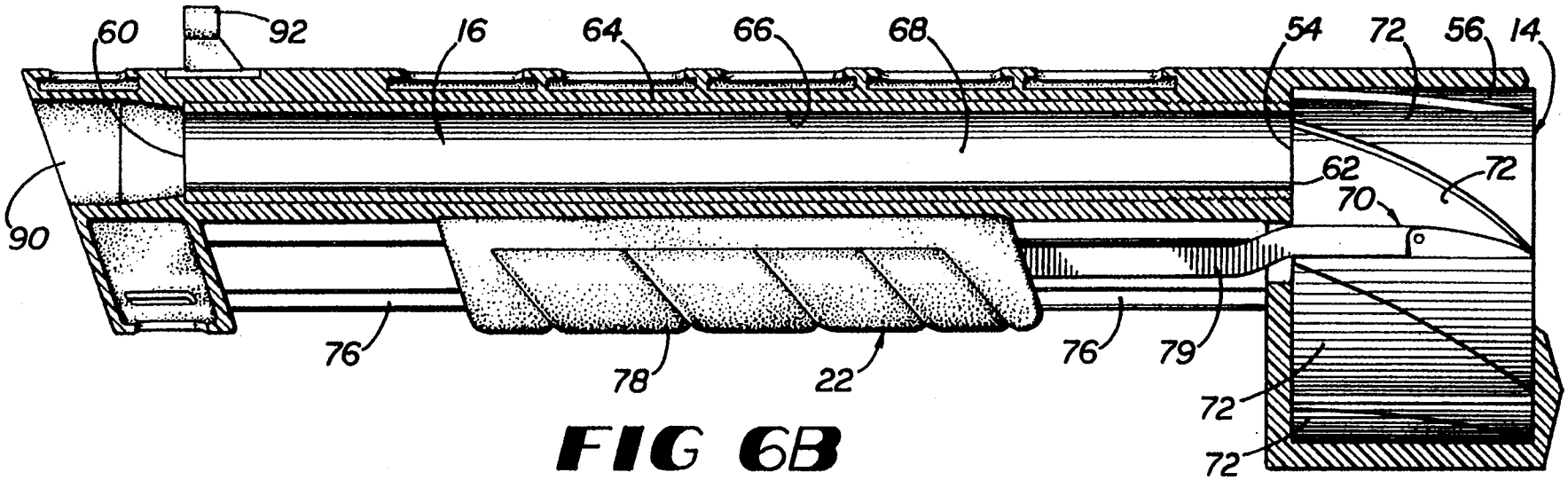

Referring now to FIGS. 6A and 6B, the means 70 to rotate the magazine 14 aligns each sequential ammunition round 12 with the barrel 16. In the presently preferred embodiment shown in FIG. 4B, the middle curved exterior side 56 of the magazine 14 further comprises grooves 72 curved relative to the longitudinal axis of the magazine 14. In conjunction, as shown in FIGS. 6A and 6B, the rotation means 70 comprises a pump type slide 22 having a track 76 adjacent and parallel to the longitudinal axis of the barrel 16, a hand grip 78 slidably connected to the track 76, and an advancer 79 connected to the hand grip 78 and slidably connected to the grooves 72 of the magazine 14. When the hand grip 78 is moved from adjacent the front end 60 to adjacent the rear end 62 and then back adjacent to the front end 60 of the barrel 16, the advancer 79 transverses the grooves 72 causing the magazine 14 to rotate to the next sequential ammunition round 12. This process may be repeated until all the ammunition rounds 12 in the magazine 14 have been fired.

The weapon system 10 may further comprise a means 82 for absorbing the recoil force resulting from firing the ammunition round 12. The recoil force controlling means 82 may comprise a rifle butt 84 having a distal end 86 adjacent to both the magazine 14 and the igniting means 20 and having a proximal end 88 placed against user's shoulder.

In the presently preferred embodiment, the weapon system 10 may further comprise a flash-hinder 90 adjacent to the front end 60 and attached to the outside 64 of the barrel 16, a front sight 92 adjacent to the front end 60 and attached to the outside 64 of the barrel 16, a rear sight 94 adjacent to the back end 62 and attached to the outside 64 of the barrel 16, and a ventilated hand guard 96 surrounding the outside 64 of the barrel 16. Additionally, in the presently preferred embodiment, the weapon system 10 may further comprise a safety 98 for the trigger mechanism 36, and a pistol grip adjacent 95 to the trigger mechanism 36 and the magazine 14.

Although the present process has been described with reference to specific details of certain embodiments thereof, it is not intended that such details should be regarded as limitations upon the scope of the invention except as and to the extent that they are included in the accompanying claims.

What is claimed is:

1. A disposable, lightweight, shoulder-fired, flat-trajectory, multi-shot weapon system comprising:

a. at least one ammunition round comprising a projectile, a propellant charge, and a casing for containing said propellant charge and for securing and sealing said projectile;

b. means for igniting the propellant charge of said ammunition rounds, thereby firing each of said ammunition rounds;

c. a plurality of cylinders each having an inner surface forming an inner volume complementary in size to and capable of slidably receiving one of said ammunition rounds therein, said cylinder further comprising a concave end cap attached to one end of said cylinder so as to form a pressure tight seal strong enough to withstand the firing forces of said ammunition round;

d. a magazine having a plurality of through-bores complementary to and surrounding a plurality of said cylinders so as to allow multiple firings of ammunition rounds from said weapon system;

e. a barrel forward of said magazine, having a front end, a rear end adjacent to said magazine, an outside surface, and an inside surface forming a central bore aligned with one of said cylinders within said magazine and forming a pressure tight seal with said cylinders so as to allow the projectiles of said ammunition round to transverse the central bore and exit the front end of said barrel; and f. means to rotate said magazine so as to sequentially align each of said ammunition rounds with said barrel.

2. The weapon system of claim 1, further comprising a means for absorbing the recoil force of firing said ammunition round.

3. The weapon system of claim 1, wherein said cylinder and said attached concave end cap are high strength alloys capable of withstanding approximately 6400 psi average pressure and approximately 15,000 psi peak pressure.

4. The weapon system of claim 1, wherein said rotation means comprises a pump type slide having a track adjacent and parallel to the longitudinal axis of said barrel, a hand grip slidably connected to said track, and an advancer connected to said hand grip and slidably connected to grooves on the exterior of said magazine, wherein when said hand grip is moved from adjacent the front end to adjacent the rear end and back adjacent to the front end of said barrel said advancer rotates said magazine to the next sequential ammunition round.

5. The ammunition round of claim 1, wherein the ammunition round consist of a high strength alloy.

6. The ammunition round of claim 5, wherein the high strength alloy is a titanium alloy.

7. The magazine of claim 1, wherein the magazine consists of light-weight, moldable material.

8. The magazine of claim 7, wherein the magazine consists of carbon graphics.

9. The magazine of claim 7, wherein the magazine consists of ceramic materials.

10. A light-weight, shoulder-fired, flat-trajectory, disposable, multi-shot weapon system comprising:

a. at least one ammunition round comprising a projectile, a propellant charge, and a casing strong enough to withstand the firing forces of said ammunition round containing said propellant charge and for securing and sealing said projectile;

b. means for igniting the propellant charge of said ammunition rounds, thereby firing said ammunition round;

c. a plurality of cylinders each having an inner surface forming an inner volume complementary in size to and capable of slidably receiving one of said ammunition rounds therein, said cylinder further comprising a concave end cap attached to one end of said cylinder;

d. a magazine having a plurality of through-bores complementary to and surrounding a plurality of said cylinders so as to allow multiple firings of ammunition rounds from said weapon system;

e. a barrel forward of said magazine, having a front end, a rear end adjacent to said magazine, an outside surface, and an inside surface forming a central bore aligned with one of said cylinders within said magazine and forming a pressure tight seal with said cylinders so as to allow the projectiles of said ammunition round to transverse the central bore and exit the front end of said barrel; and f. means to rotate said magazine so as to sequentially align each of said ammunition rounds with said barrel.

11. A light-weight, shoulder-fired, flat-trajectory, disposable, multi-shot weapon system comprising:

a. at least one ammunition round comprising a projectile, a propellant charge, and a casing for containing said propellant charge and for securing and sealing said projectile;

b. means for igniting the propellant charge of said ammunition rounds, thereby firing said ammunition round;

c. a magazine strong enough to withstand the firing forces of said ammunition rounds having a plurality of through-bores complementary to and surrounding a plurality of said cylinders so as to allow multiple firings of ammunition rounds from said weapon system;

d. a barrel forward of said magazine, having a front end, a rear end adjacent to said magazine, an outside surface, and an inside surface forming a central bore aligned with one of said cylinders within said magazine and forming a pressure tight seal with said cylinders so as to allow the projectiles of said ammunition round to transverse the central bore and exit the front end of said barrel; and e. means to rotate said magazine so as to sequentially align each of said ammunition rounds with said barrel.

* * * * *